United States Patent [19]

Warncke et al.

[11] 4,364,384

[45] Dec. 21, 1982

[54] EXCESS PRESSURE RESPIRATOR WITH PRESSURIZED BREATHING GAS SHUTOFF

[75] Inventors: Ernst Warncke, Lübeck; Adalbert Pasternack, Bad Schwartau, both of Fed. Rep. of Germany

[73] Assignee: Drägerwerk Aktiengesellschaft, Fed. Rep. of Germany

[21] Appl. No.: 249,085

[22] Filed: Mar. 30, 1981

[30] Foreign Application Priority Data

Apr. 24, 1980 [DE] Fed. Rep. of Germany ..... 3015759

[51] Int. Cl.[3] ..... A62B 7/04

[52] U.S. Cl. ..... 128/204.28; 128/205.12; 128/205.16

[58] Field of Search ..... 128/204.26, 204.27, 128/204.28, 205.12, 205.13, 205.14, 205.15, 205.16, 205.24; 417/328, 443, 349; 137/495, 505.42, 505.46, 505.18, 458, 463

[56] References Cited

U.S. PATENT DOCUMENTS

| | | | |
|---|---|---|---|
| 2,853,268 | 9/1958 | Hughes | 137/505.18 |
| 2,900,977 | 8/1959 | Marsh | 128/204.23 |
| 3,180,356 | 4/1965 | Galley | 137/495 |
| 3,692,047 | 9/1972 | Camp | 137/495 |
| 3,794,021 | 2/1974 | Lambertsen | 128/204.28 |
| 4,252,114 | 2/1981 | Seres et al. | 128/205.16 |

*Primary Examiner*—Henry J. Recla
*Attorney, Agent, or Firm*—McGlew and Tuttle

[57] ABSTRACT

An excess pressure respirator with automatic or manual shutoff valve is disclosed. A breathing bag having at least one movable plate member is utilized to receive and supply breathing air from a user. The plate member is biased to reduce the volume of the bag and apply pressure to the contents of the bag. A pressurized gas source is connected through a connecting line to the bag. A dosing valve is positioned in the connecting line to be opened when the volume of the bag is reduced during an inhalation cycle and then closed so that a dosed quantity of oxygen is supplied to the bag. A shutoff valve is also provided in the connection for shutting flow of breathing gas from the source entirely when the bag falls below a minimum volume which is indicative of a large leak or the removal of a gas mask from the user's face. A manual shutoff may also be provided in the form of a movable block which stops the movement of the biased plate member before it engages the dosing valve to open it.

7 Claims, 2 Drawing Figures

EXCESS PRESSURE RESPIRATOR WITH PRESSURIZED BREATHING GAS SHUTOFF

FIELD AND BACKGROUND OF THE INVENTION

The present invention relates in general to respirators and, in particular, to a new and useful excess pressure respirator having an automatic or manual shutoff mechanism for stopping the flow of pressurized breathing gas when the respirator is not in use.

Circulating respirators with excess pressure in the respiratory cycle chamber ensure excess pressure during use both in the expiration and in the inspiration phase of the respiratory cycle. This excess pressure under any circumstances prevents penetration of ambient air into the respiratory cycle chamber which could be dangerous. Possible leaks in the apparatus only cause gas current from the inside to the outside.

All such known apparatus have the great disadvantage, however, that the breathing gas storage tanks must be closed at the end of use and removal of the oxygen mask, hence the opening of the respiratory cycle chamber, otherwise the breathing gas would flow off and the time which the apparatus can be used would be shortened.

This also applies to the known circulating respirator with excess pressure in the respiratory cycle described below. In such a device the breathing gas flows to the carrier and user of the device from a breathing bag through an inhaling tube with an inhaling valve just ahead of the oxygen mask. The exhaled gas arrives over an exhaling valve in the exhaling tube and through the tube and a $CO_2$ absorber, back to the breathing bag. In order to build up the excess pressure, the breathing bag is loaded from the outside with a spring.

In order to protect the user, oxygen is supplied continuously to the breathing bag from the oxygen cylinder over a pressure reducer and additionally through an emergency valve. The emergency valve is controlled by movement of the breathing bag, which emergency may result from the movement of the breathing gas. The valve opens with the collapse of the breathing bag, and closes again with its inflation. Before removing the oxygen mask, the cylinder valve must be closed. If this not done, a large amount of oxygen will be lost because, when the respiratory cycle chamber is opened (this is done with the removal of the oxygen mask or in case of a large leak) the excess pressure drops. The breathing bag is thus compressed by the outer spring, and the emergency valve is opened. Oxygen thus can escape (see Brochure BP-0878, BioMarine Industries, Inc.).

SUMMARY OF THE INVENTION

An object of the present invention is to supplement a respiratory cycle so that the controlled emergency valve, here the lung machine or regulator is closed by removing the oxygen mask or in case of a large leak.

Another object of the present invention is thus to provide an excess pressure respirator comprising a breathing bag having at least one movable plate member which moves with changes of volume in said bag, biasing means connected to the plate member for biasing the plate member in a direction to deflate the bag, at least one respirator line connected to the bag for inhalation and exhalation from and to the bag, a pressurized breathing gas source, connecting means between the source and the bag for supplying breathing gas under pressure to the bag, a dosing valve in the connecting means for passing breathing gas to the bag in an open position thereof and for blocking such flow in a closed position thereof, the plate member engaged with the dosing valve to open the dosing valve when the bag is deflated during an inhalation cycle, and a shutoff valve in the connecting means for passing breathing gas in its open position and for blocking such passage in a closed position, a plate member engaged with the shutoff valve tp close the shutoff valve when the bag is further deflated during a reduction in pressure below that pressure which appears in the bag during an inhalation cycle.

A still further object of the present invention is to provide such a device which, rather than having an automatically operable shutoff valve, includes a manually operable mechanism for blocking the movement of the plate member before it opens the dosing valve so that pressurized breathing gas is not supplied from the source to the bag.

Another object of the invention is to provide a connecting line which forms a connecting means, the shutoff valve having a seat in the connecting line through which the breathing gas flows and a closing bolt movable by the plate member into engagement with the seat to stop a flow of breathing gas.

A still further object of the invention is to provide an oxygen pressure tank with pressure reducer and connecting line as the pressurized breathing gas source.

With the removal of the mask or in the case of large leaks in the respiratory cycle chamber, the locking mechanism or shutoff valve in the connecting line through which oxygen is supplied closes automatically. There can thus no longer be any unnecessary oxygen loss. This can be life-saving for the user, due to the prolonged use of the oxygen supply. The locking mechanism is simple in design and reliable.

For special cases where an automatic system is no longer required, a manually operated lock adjusting device is provided. The lock adjusting device is simple in design and easy to operate. It prevents the opening of the lung machine with falling pressure in the respiratory cycle.

Another object of the invention thus is to provide an excess pressure respirator with automatic or manual shutoff for the pressurized oxygen or breathing gas source which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
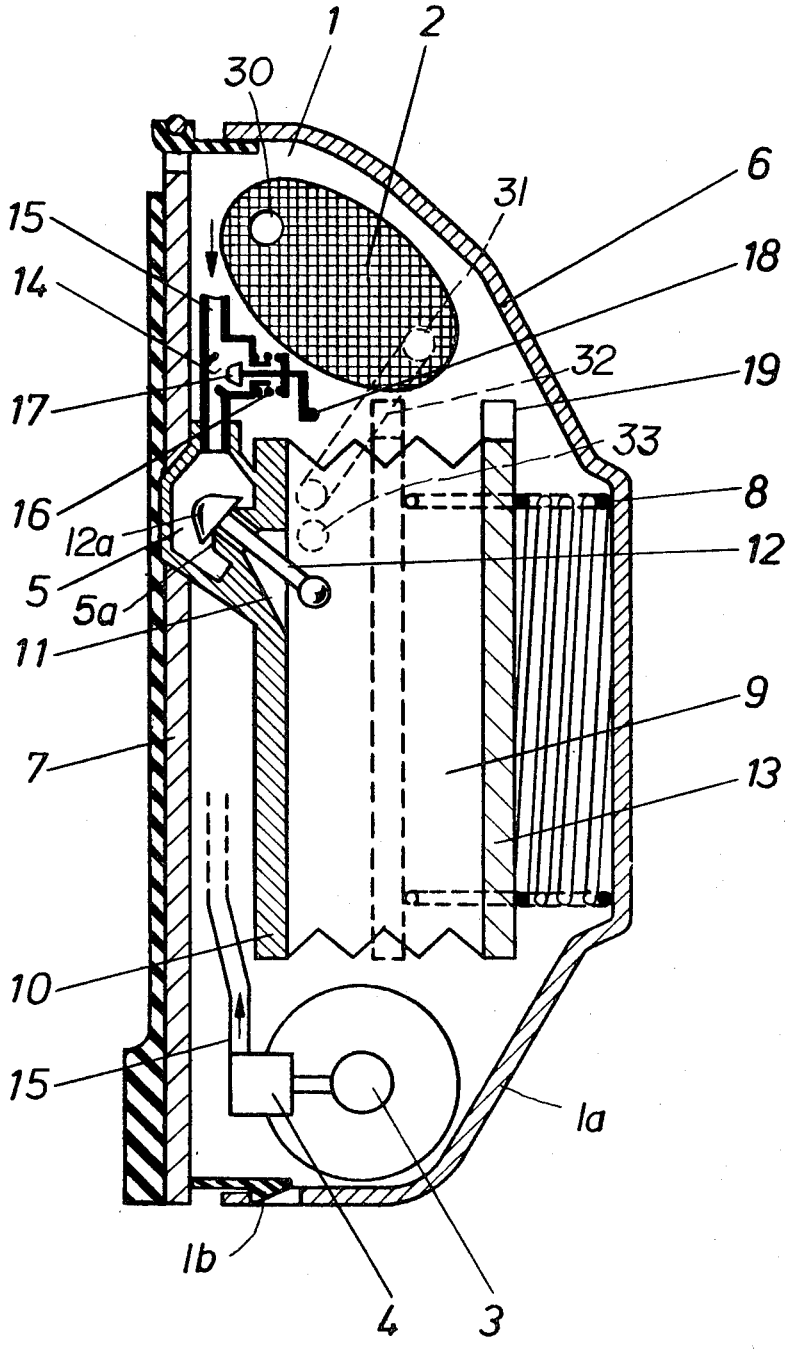
FIG. 1 is a schematic sectional view of a device according to the invention.

Referring to the drawings in particular, the invention embodied in FIG. 1 comprises an excess pressure regulator which is adapted to be carried on a user's back for example, by a supporting frame 7. The excess pressure respirator 1 is contained within a housing member 1*a* which is connected through elastic bushings 1*b*, for example or other known means to the frame 7.

The compressed oxygen cycle respirator 1 with excess pressure in the respiratory cycle, contains a regenerating cartridge 2 which binds the carbon dioxide in the exhaling air, an oxygen pressure tank 3 which is connected over a pressure reducer 4 to a lung machine or regulator 5, and has also in an outer protective shell 6 on the supporting frame 7 a breathing bag 9 actuated by a spring 8. Regulator 5 acts as a dosing valve to dose bag 9 with oxygen. In a bottom 10 of breathing bag 9 is provided a bushing 11 for the regulator lever 12. The generally known connections of the exhaling tube over the regenerating cartridge 2 to breathing bag 9 and the inhaling tube from the bag to the mask are shown generally at 30 to 33.

During the expiration phase, breathing bag 9 is filled with breathing air (over 31) and is kept under pressure by its expansion and tensioning spring 8 which acts on plate 13, biasing it to the left in FIG. 1. During inhalation, breathing bag 9 is emptied by means of spring 8 and over opening 33. Upper plate 13, which seals breathing bag 9, strikes against regulator or lung machine lever 12 at the end of the normal inhalation when the excess pressure from the partial tension of spring 8 is still present, and opens regulator 5. Lever 12 tilts member 12*a* off seat 5*a*. Oxygen thus flows into breathing bag 9, supplied over pressure reducer 4. With the beginning expiration phase, breathing bag 9 fills up again and the breathing air mixes with the entering oxygen. Member 12*a* is forced over seat 5*a* when plate 13 lifts off lever 12, under the oxygen pressure in regulator 5.

A locking mechanism 14 in connecting line 15 between pressure reducer 4 and lung machine 5 has a lever 18 connected to a bolt pin 17 held in open position by a tension spring 16. Against this lever 18 strikes a projection 19 of upper plate 13 when a pressure drop occurs in breathing bag 9, which is below that of normal inhalation and is moved by spring 8 immediately after regulator 5 opens, and cocks locking mechanism 14 by tensioning spring 16. Bolt 17 thus moves to stop flow in mechanism 14. Line 15 from reducer 4 can be directly connected to mechanism 14 or can open into the chamber of respirator 1 which communicates with 14 as shown in FIG. 1. The oxygen supply to breathing bag 9 is thus stopped, despite the open regulator 5. Such a complete pressure drop results when the mask is removed or a large leak appears in the respiratory cycle.

Figure 2:
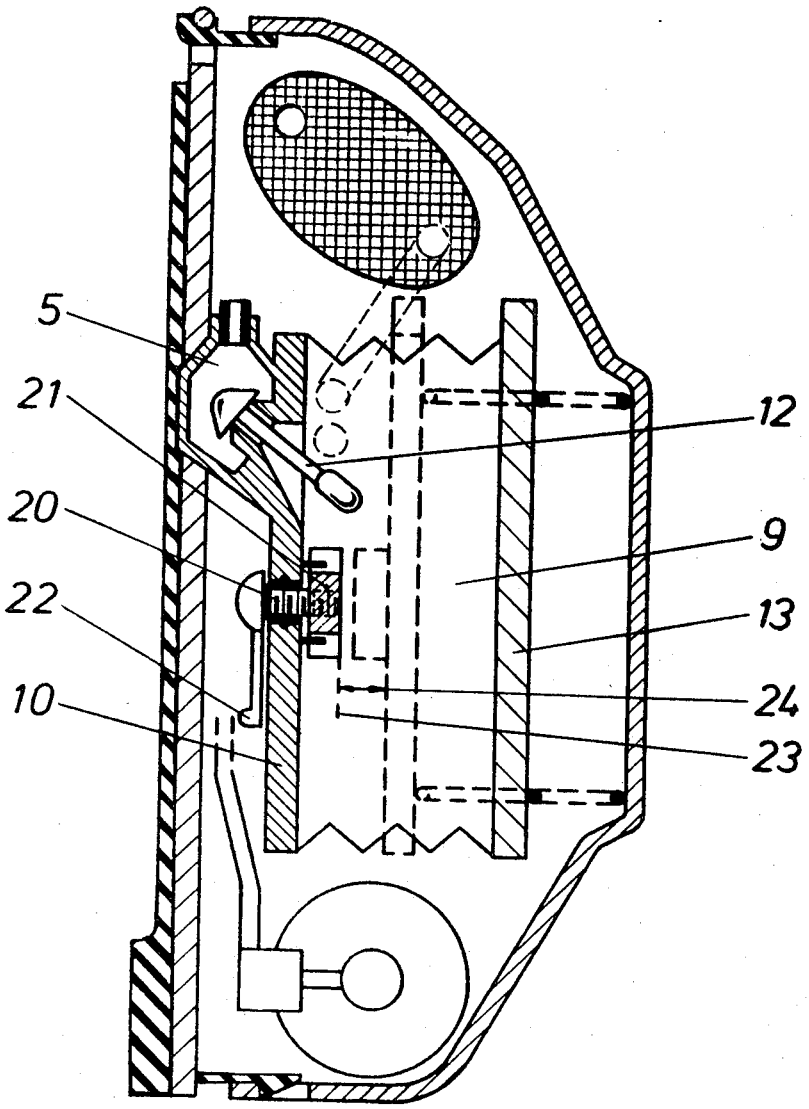
FIG. 2 is a view similar to FIG. 1 of another embodiment of the invention.

For special cases it suffices to interrupt the circuit of lung machine or regulator 5 by hand. Locking mechanism 14 according to FIG. 1 is here not necessary. In this embodiment, (see FIG. 2) a bottom plate 10 of bag 9 has a lock adjusting device 20 with an adjusting plate 21 and a rotary lever 22. With a rotation of rotary lever 22, adjusting plate 21 is displaced from operating position 23 in the direction of upper plate 13 into locking position 24, so that its path is shortened when breathing bag 9 empties. It no longer reaches lung machine lever 12, so that lung machine 5 remains closed, and unnecessary consumption of oxygen is prevented in an open respiratory circuit.

Device 20 may be a threaded shaft which is threaded into plate 21 for example, to displace plate 21 to the right when lever 22 is rotated. Other parts in FIG. 2 with similar numbers have similar functions.

While specific embodiments of the invention have been shown and described in detail to illustrate the application of the principles of the invention, it will be understood that the invention may be embodied otherwise without departing from such principles.

What is claimed is:

1. An excess pressure respirator comprising:

a housing;

a breathing bag mounted to said housing and having at least one movable plate member which moves with change of volume in said bag;

biasing means engaged with said plate member for biasing said plate member in a direction to deflate said bag;

at least one respiration line connected to said bag for inhalation and exhalation cycles from and to said bag;

a pressurized breathing gas source mounted to said housing;

connecting means between said source and said bag for supplying breathing gas to said bag from said source;

a dosing valve in said connecting means for passing breathing gas to said bag in an open position and for blocking such in a closed position, said dosing valve having an actuator and being mounted in said housing such that said actuator is in the path of said movable plate member and said plate member engages the actuator of said dosing valve to open said dosing valve when said bag is deflated during an inhalation cycle; and a shutoff valve in said connecting means for passing breathing gas therethrough in an open position and for blocking breathing gas therethrough in a closed position, said shutoff valve having an actuator and being mounted in said housing such that said actuator is in the path of said movable plate member and said plate member engages the actuator of said shutoff valve for closing said shutoff valve when said bag is further deflated during a reduction of pressure in said bag below that of an inhalation cycle.

2. A respirator according to claim 1, wherein said connecting means includes a connecting line connected between said source and said bag, said shutoff valve comprising a valve seat in said connecting line and a valve bolt movable against said connecting line to close said shutoff valve.

3. A respirator according to claim 1, wherein said pressurized breathing gas source comprises an oxygen tank and a pressure reducer connected between said oxygen tank and said connecting means.

4. A respirator according to claim 1, wherein said dosing valve includes a valve chamber for receiving pressurized breathing gas having a valve seat, a seat closing member held against said valve seat by pressurized breathing gas in the closed position of said dosing valve and a valve lever connected to said seat closing member and extending into said bag, said valve member engaged by said plate member to open said dosing valve.

5. A respirator according to claim 2, including a valve lever connected to said closing bolt and a biasing spring engaged with said lever to hold said bolt away from said shutoff valve seat when said shutoff valve is open, said lever engaged by said plate member with said bag further deflated to close said shutoff valve.

6. An excess pressure respirator comprising:

a housing;

a breathing bag mounted to said housing and having at least one movable plate member which moves with change of volume in said bag;

biasing means engaged with said plate member for biasing said plate member in a direction to deflate said bag;

at least one respiration line connected to said bag for inhalation and exhalation cycles from and to said bag;

a pressurized breathing gas source mounted to said housing;

connecting means between said source and said bag for supplying breathing gas to said bag from said source;

a dosing valve in said connecting means for passing breathing gas to said bag in an open position and for blocking such in a closed position, said dosing valve having an actuator and being mounted in said housing such that said actuator is in the path of said movable plate member and said plate member engages the actuator of said closing valve to open said dosing valve when said bag is deflated during an inhalation cycle; and manually movable blocking means mounted in said housing with respect to said plate member such that said blocking means is movable from a first position to permit movement of said plate member to open said dosing valve, to a second position for blocking movement of said plate member during deflation of said bag before said plate member engages said dosing valve.

7. A respirator according to claim 6, wherein said blocking means comprises a block member movably mounted in said bag, an engagement lever extending out of said bag and connected to said block for manual movement thereof and movement of said block.

* * * * *